US006752744B2

(12) United States Patent
Arnold et al.

(10) Patent No.: US 6,752,744 B2
(45) **Date of Patent: *Jun. 22, 2004**

(54) EXERCISE DEVICE

(75) Inventors: Peter Arnold, Seattle, WA (US); Philip S. Lamb, Bothell, WA (US); Michael Baum, Kirkland, WA (US); Mark Sand, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 423 days.

This patent is subject to a terminal disclaimer.

(21) Appl. No.: 09/867,782

(22) Filed: May 29, 2001

(65) Prior Publication Data

US 2001/0023219 A1 Sep. 20, 2001

Related U.S. Application Data

(63) Continuation of application No. 09/419,404, filed on Oct. 14, 1999, now Pat. No. 6,238,321.

(51) Int. Cl.[7] ..... A63B 69/16; A63B 22/04
(52) U.S. Cl. ..... 482/52; 482/51
(58) Field of Search ..... 482/51–53, 57–65, 482/70–72, 95–96

(56) References Cited

U.S. PATENT DOCUMENTS

| | | | |
|---|---|---|---|
| 219,439 | A | 9/1879 | Blend |
| 518,757 | A | 4/1894 | Hoyt |
| 1,273,906 | A | 7/1918 | Nickey |
| 1,323,004 | A | 11/1919 | Boyd |
| 2,603,486 | A | 7/1952 | Hughes |
| 2,641,249 | A | 6/1953 | Brockman |
| 2,826,192 | A | 3/1958 | Mangas |
| 2,892,455 | A | 6/1959 | Hutton |
| 3,316,898 | A | 5/1967 | Brown |
| 3,432,164 | A | 3/1969 | Deeks |
| 3,475,021 | A | 10/1969 | Ruegsegger |

(List continued on next page.)

FOREIGN PATENT DOCUMENTS

| | | |
|---|---|---|
| CH | 0206208 | 7/1939 |
| DE | 29 19 494 | 11/1980 |
| RU | 1600816 | 10/1990 |

*Primary Examiner*—Stephen R. Crow
(74) *Attorney, Agent, or Firm*—Christensen O'Connor Johnson Kindness PLLC

(57) ABSTRACT

The exercise device (10) exercises both the upper and lower body in associated motion, while preventing derailment or other related instability of the lower body linkage, due to the connection and force imparted from the upper body linkage. The device includes a frame (12) which has a forward upright member (20). The axle mounts (30) and (32) are attached to the rear region of the frame (12) and support a transverse axle (34) which is preferably operatively connected to a flywheel (36). The ends of the transverse axle (34) rotatably engage left and right crank arm assemblies (40) and (50) that are coupled to the left and right foot links (60) and (70) so that the foot links travel in an arcuate reciprocal path as the transverse axle rotates. The forward ends (62) and (72) of the foot links terminate in rollers (68) and (78), which engage guide tracks (42) and (52) that are mounted to the frame. The forward ends (62) and (72) of the foot links are operatively connected to safety engagement assemblies (100) and (110), which in turn are operatively connected to coupling regions (86) and (96) of swing arm mechanisms. The swing arm mechanisms are rotatably connected to the forward upright member (20) at pivot points (84) and (94). The swing arm mechanisms further contain hand-gripping portions (82) and (92), and the foot links further contain foot support portions (66) and (76). Each safety engagement assembly includes an abutment arm (106) and (116), and a curved attachment link (104) and (114), which together prevent the derailment of the foot link rollers (68) and (78) from the guide tracks (42) and (52).

28 Claims, 7 Drawing Sheets

U.S. PATENT DOCUMENTS 3,566,861 A 3/1971 Weiss
3,713,438 A 1/1973 Knutsen
3,759,511 A 9/1973 Zinkin et al.
3,824,994 A 7/1974 Soderberg, Sr.
4,023,795 A 5/1977 Pauls
4,053,173 A 10/1977 Chase, Sr.
4,185,622 A 1/1980 Swenson
4,188,030 A 2/1980 Hooper
4,379,566 A 4/1983 Titcomb
4,456,276 A 6/1984 Bortolin
4,505,473 A 3/1985 Pro
4,509,742 A 4/1985 Cones
4,555,109 A 11/1985 Hartmann
4,561,318 A 12/1985 Schirrmacher
4,645,200 A 2/1987 Hix
4,679,786 A 7/1987 Rodgers
4,700,946 A 10/1987 Breunig
4,720,093 A 1/1988 Del Mar
4,779,863 A 10/1988 Yang
4,786,050 A 11/1988 Geschwender
D299,369 S 1/1989 Smith et al.
4,842,268 A 6/1989 Jenkins
4,869,494 A 9/1989 Lambert, Sr.
4,900,013 A 2/1990 Rodgers, Jr.
4,949,954 A 8/1990 Hix
4,949,993 A 8/1990 Stark et al.
4,986,261 A 1/1991 Iams et al.
4,989,857 A 2/1991 Kuo
5,029,848 A 7/1991 Sleamaker
5,038,758 A 8/1991 Iams et al.
5,039,087 A 8/1991 Kuo
5,039,088 A 8/1991 Shifferaw
5,131,895 A 7/1992 Rogers, Jr.
5,135,447 A 8/1992 Robards, Jr. et al.
5,149,312 A 9/1992 Croft et al.
D330,236 S 10/1992 Jarriel et al.
5,169,363 A 12/1992 Campanaro et al.
5,186,697 A 2/1993 Rennex
5,242,343 A 9/1993 Miller
5,269,736 A 12/1993 Roberts
5,279,529 A 1/1994 Eschenbach
5,279,530 A 1/1994 Hess
5,290,211 A 3/1994 Stearns
5,295,928 A 3/1994 Rennex
5,299,993 A 4/1994 Habing
5,352,169 A 10/1994 Eschenbach
5,383,829 A 1/1995 Miller
5,387,167 A 2/1995 Johnston
5,401,226 A 3/1995 Stearns
5,403,255 A 4/1995 Johnston
5,423,729 A 6/1995 Eschenbach
5,499,956 A 3/1996 Habing et al.
5,518,473 A 5/1996 Miller
D372,282 S 6/1996 Pasero et al.
5,527,246 A 6/1996 Rodgers, Jr.
5,529,554 A 6/1996 Eschenbach
5,540,637 A 7/1996 Rodgers, Jr.
5,549,526 A 8/1996 Rodgers, Jr.
5,562,574 A 10/1996 Miller
5,573,480 A 11/1996 Rodgers, Jr.
5,577,985 A 11/1996 Miller
5,593,371 A 1/1997 Rodgers, Jr.
5,593,372 A 1/1997 Rodgers, Jr.
5,595,553 A 1/1997 Rodgers, Jr.
5,611,756 A 3/1997 Miller
5,637,058 A 6/1997 Rodgers, Jr.
5,653,662 A 8/1997 Rodgers, Jr.
5,683,333 A 11/1997 Rodgers, Jr.
5,685,804 A 11/1997 Whan-Tong et al.
5,690,589 A 11/1997 Rodgers, Jr.
5,738,614 A 4/1998 Rodgers, Jr.
5,743,834 A 4/1998 Rodgers, Jr.
5,766,113 A 6/1998 Rodgers, Jr.
5,772,558 A 6/1998 Rodgers, Jr.
5,779,599 A * 7/1998 Chen ..... 482/57
5,848,954 A 12/1998 Stearns et al.
5,857,941 A 1/1999 Maresh et al.
D408,477 S 4/1999 Arnold et al.
5,897,461 A 4/1999 Socwell
D410,978 S 6/1999 Littrell et al.
6,238,321 B1 * 5/2001 Arnold et al. ..... 482/52
6,254,514 B1 * 7/2001 Maresh et al. ..... 482/52

* cited by examiner

EXERCISE DEVICE

CROSS-REFERENCE TO RELATED APPLICATION

This application is a continuation of prior application Ser. No. 09/419,404, filed Oct. 14, 1999 now U.S. Pat. No. 6,238,321, priority from the filing date of which is hereby claimed under 35 U.S.C.§ 120.

FIELD OF THE INVENTION

The present invention relates to exercise equipment, and more specifically to a stationary exercise device that links upper and lower body movements in a safe and stable manner.

BACKGROUND OF THE INVENTION

The benefits of regular aerobic exercise have been well established and accepted. However, due to time constraints, inclement weather, and other reasons, many people are prevented from aerobic activities such as walking, jogging, running, and swimming. In response, a variety of exercise equipment have been developed for aerobic activity. It is generally desirable to exercise a large number of different muscles over a significantly large range of motion so as to provide for balanced physical development, to maximize muscle length and flexibility, and to achieve optimum levels of aerobic exercise. A further advantageous characteristic of exercise equipment, is the ability to provide smooth and natural motion, thus avoiding significant jarring and straining that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art, however this machine employs a sitting position which utilizes only a relatively small number of muscles, throughout a fairly limited range of motion. Cross-country skiing devices are also utilized by many people to simulate the gliding motion of cross-country skiing. While this device exercises more muscles than a stationary bicycle, the substantially flat shuffling foot motion provided thereby, limits the range of motion of some of the muscles being exercised. Another type of exercise device simulates stair climbing. These devices exercise more muscles than do stationary bicycles, however, the rather limited range of up-and-down motion utilized does not exercise the user's leg muscles through a large range of motion. Treadmills are still a further type of exercise device in the prior art, and allow natural walking or jogging motions in a relatively limited area. A drawback of the treadmill, however, is that significant jarring of the hip, knee, ankle and other joints of the body may occur through use of this device.

A further limitation of a majority of exercise systems in the prior art, is that the systems are limited in the types of motions that they can produce, such as not being capable of producing elliptical motion. Exercise systems create elliptical motion, as referred to herein, when the path traveled by a user's feet while using the exercise system follows an arcuate or ellipse-shaped path of travel. Elliptical motion is much more natural and analogous to running, jogging, walking, etc., than the linear-type, back and forth motions produced by some prior art exercise equipment.

Exercise devices are also desirable which provide the additional advantage of being configured to provide arm and shoulder motions, as well as arcuate foot motions. Prior art devices utilizing arm and shoulder motions that are linked to foot motions incorporate forced coordinated motion, where the motions of a user's feet are linked to the motions of a user's arms and shoulders, so that one's feet are forced to move in response to the movement of one's arms and shoulders (in substantially an equal and opposite amount), and vice versa. Still other prior art devices limit the range of motions utilized by their systems, which can result in detrimental effects on a user's muscle flexibility and coordination due to the continued reliance on the small range motion produced by these exercise devices, as opposed to the wide range of natural motions that are experienced in activities such as running, walking, etc.

Despite the large number of exercise devices known in the prior art there is still a need for an exercise device which produces elliptical foot movement, and incorporates substantially related arm and shoulder rotational motions that are linked to the foot movements of the user. Another continuing problem in the art for exercise devices that work both the upper and lower body in associated motion, has been the tendency for upper body linkage to destabilize lower body linkage due to the upward force imparted onto the lower body linkage from the upper body linkage. Lower body linkages typically run along some type of track mechanism. Since the upper body linkage typically connects to the front of the lower body linkage, upward momentum from the upper body linkage can cause to lower body linkage to derail from the track mechanism, or otherwise produce undesirable types of wobbling and instability. There is a continuing need for an exercise device that provides for smooth natural action, exercises a relatively large number of muscles through a large range of elliptical motion, employs arm, shoulder, and rotational movement, and provides some type of mechanism for increased safety and stability.

SUMMARY OF THE INVENTION

The present invention is directed towards a device that exercises both the upper and lower body in associated motion, while preventing derailment or other related instability of the lower body linkage, due to the connection and force imparted from the upper body linkage. The exercise device utilizes a frame to which a transverse axis is mounted. Coupling mechanisms are configured to operatively associate with foot links for associating the foot links to the transverse axis such that the foot support portion of each foot link travels in a reciprocal path as the transverse axis rotates. Each foot link includes a first end portion, a second end portion and a foot support portion therebetween. The first end portions of the foot links terminate in rollers, which engage guide tracks that are mounted to the frame. Swing arm mechanisms, which include a gripping portion, a pivot point, and a coupling region, operatively associate the coupling region of each swing arm mechanism with the respective first end portion of each foot link, by way of safety engagement assemblies. Each safety engagement assembly includes an abutment arm and a curved attachment link, which together prevent the derailment of the foot link rollers from the guide tracks.

In a preferred embodiment of the present invention, the rollers at the first end portions of the foot links rollably engage the guide rails. The upper surface of the guide rails have engagement grooves that are sized and configured to correspondingly mate with the rollers of the foot links. The safety engagement assemblies are designed to prevent the foot link rollers from derailing from the guide rail engagement grooves. Preferably, the safety engagement assemblies each include an abutment arm and a curved attachment link. The abutment arm is rotatably associated with the curved attachment link. The curved attachment links operatively connect the foot links to the abutment arms, while the abutment arms operatively connect the curved attachment links to the swing arm mechanisms.

The abutment arms further include abutment knobs that translate beneath the lower surface of the guide rails and substantially prevent the foot links from disengaging from the guide rails through intermittent contact with the guide rail lower surfaces. The lower surface of the guide rails also contain stabilizing troughs on the guide rail lower surfaces. The abutment knobs of the abutment arms are aligned with the guide rail stabilizing troughs. Preferably, the abutment knobs of the abutment arms substantially prevent the foot links from disengaging from the guide rails through intermittent contact with the guide rail stabilizing troughs.

In one preferred embodiment, the guide tracks of the present invention are mounted to the frame of the exercise device at an inclined angle from horizontal. In another preferred embodiment of the present invention, the guide tracks are not statically mounted to the frame, but rather incorporate a mechanism for selectively adjusting the inclination of guide tracks. This selective inclination adjustment mechanism may be either motorized or manually actuated. In one embodiment, the guide tracks simply pivot about a fixed axis. In yet another embodiment, the position of the guide tracks translate in their entirety, instead of being limited to purely rotational motion.

In another aspect of a preferred embodiment of the present invention, the coupling mechanisms comprise rotational crank arms that pivotally associate the transverse axis with the foot links. Preferably, at least a portion of the coupling mechanisms rotate about the transverse axis. The exercise device may further include a flywheel disposed for rotation in operative connection with the transverse axis. A resistance system, configured in operative association with the transverse axis, may also be included in the device to thereby increase the level of exercise required from the user. Additionally, the frame further comprises a forward end and an upright portion that extends upwardly and rearwardly from the forward end of the frame. The swing arm mechanisms are rotatably coupled to the forward upright portion of the frame at the pivot points of the swing arm mechanisms.

In still another aspect of a preferred embodiment, the exercise device preferably comprises at least one flexibly coordinating mechanism in operative association between the foot links that substantially relates the movement of the first and second foot links to each other, while permitting some degree of uncoordinated motion between the foot links. Preferably, flexibly coordinating members also substantially and resiliently link the movement of the foot support portions to the movement of the hand-gripping portions of the swing arm mechanisms, while permitting some degree of uncoordinated motion between the foot support portions and the hand-gripping portions. In one preferred embodiment, this is accomplished by the safety engagement assemblies comprising spring members, elastomeric members, or the like, in order to operatively associate the foot support portions with the hand-gripping portions of the swing arm mechanisms, and thereby act as the flexibly coordinating members.

An exercise device constructed in accordance with the present invention incorporates safety engagement assemblies between the device's upper body linkage and lower body linkage to simulate natural walking and running motions and exercise a large number of muscles, while maintaining the requisite safety and stability that is desired by users. Increased muscle flexibility and coordination can also be derived through the smooth, natural, coordinated motion of the present invention, without the undesirable safety and instability concerns associated with some prior art exercise equipment. This device also provides the above-stated benefits without imparting the shock to the user's body joints in the manner of prior art exercise treadmills.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

While the preferred embodiment of the invention has been illustrated and described, it will be appreciated that various changes can be made therein without departing from the spirit and scope of the invention.

Figure 1:
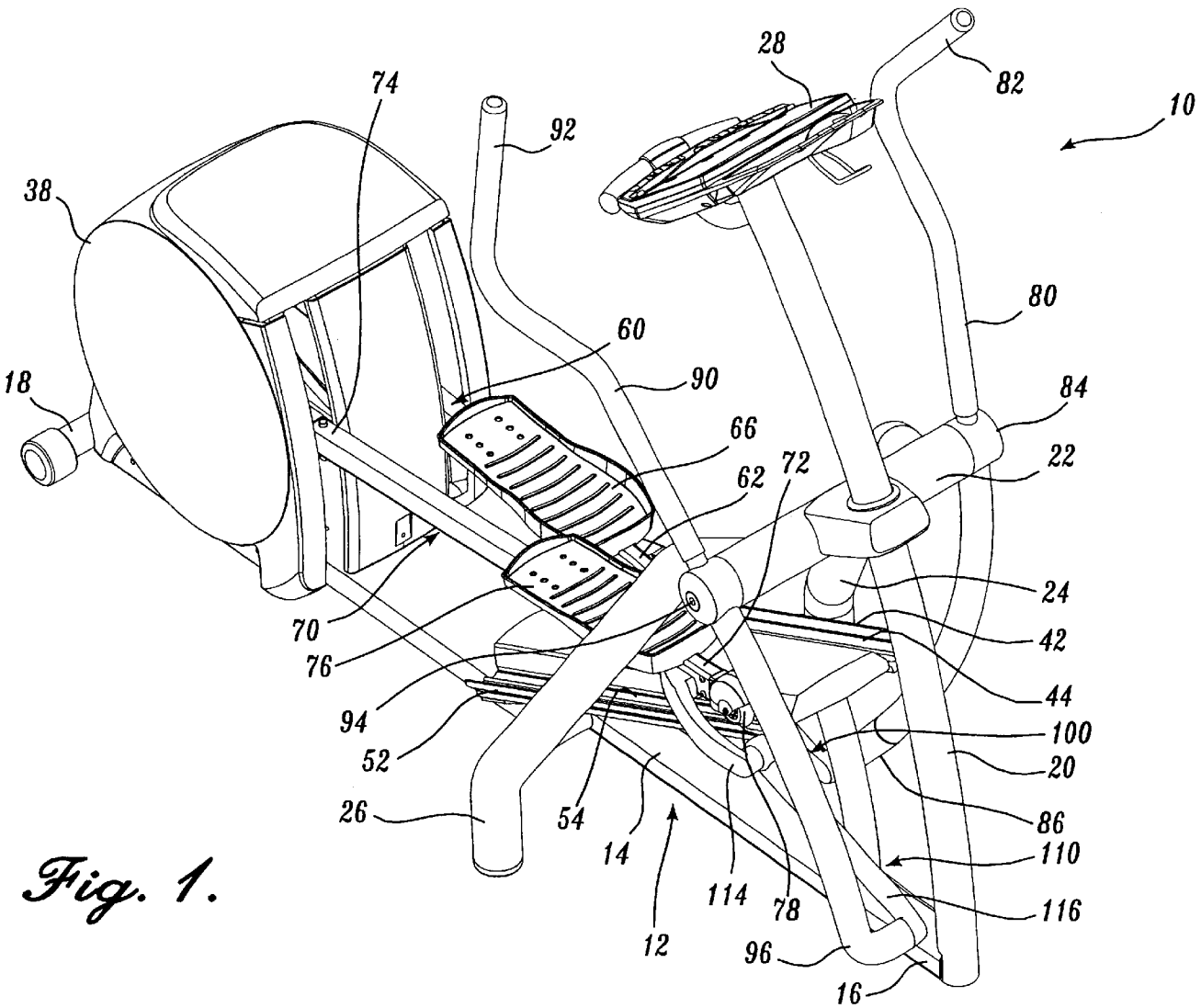
FIG. 1 illustrates an elevated front perspective view of an exercise device of the present invention, that utilizes safety engagement assemblies to prevent the derailment of the foot link rollers from the guide tracks.
Figure 2:
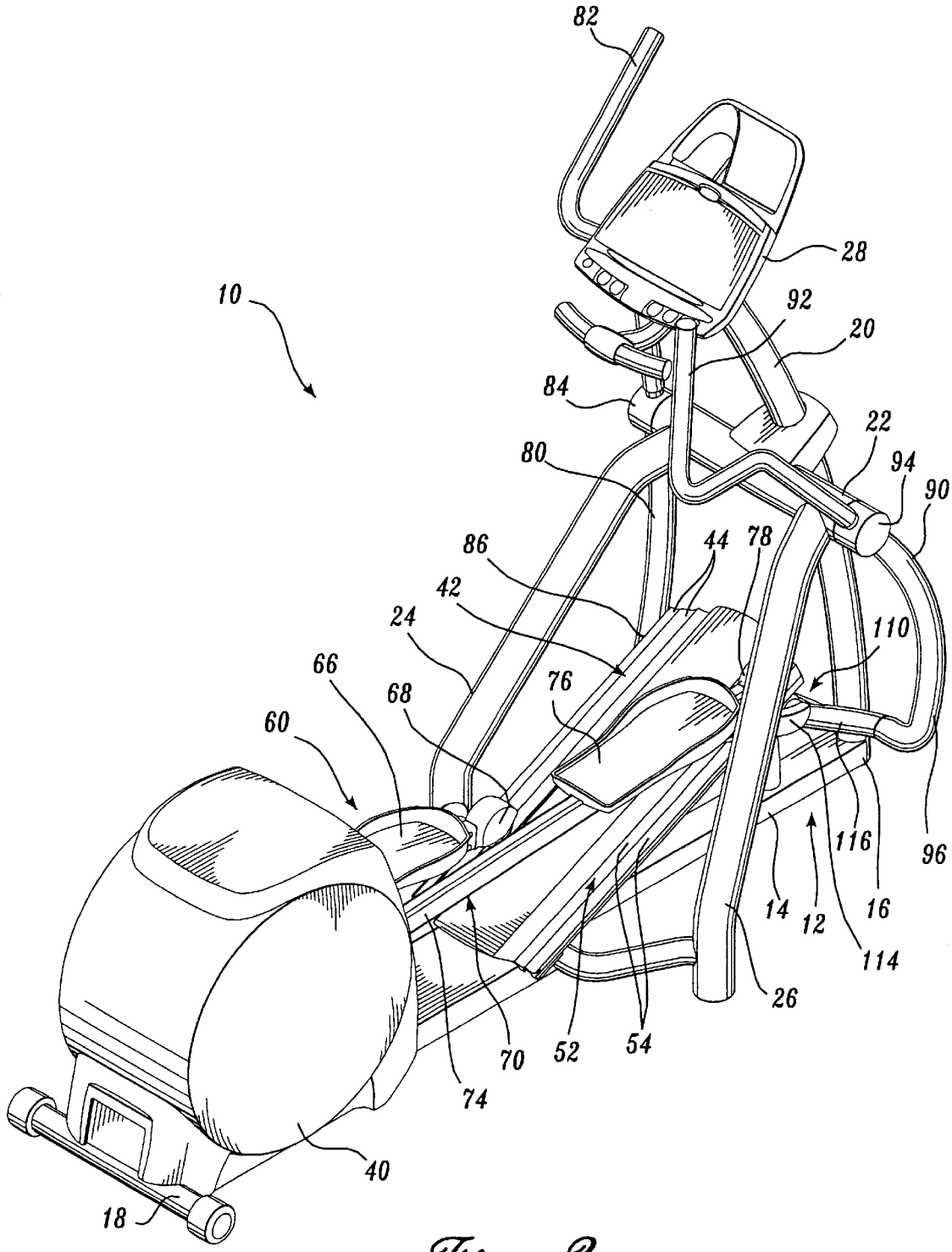
FIG. 2 illustrates an elevated rear perspective view of the exercise device of FIG. 1.
Figure 3:
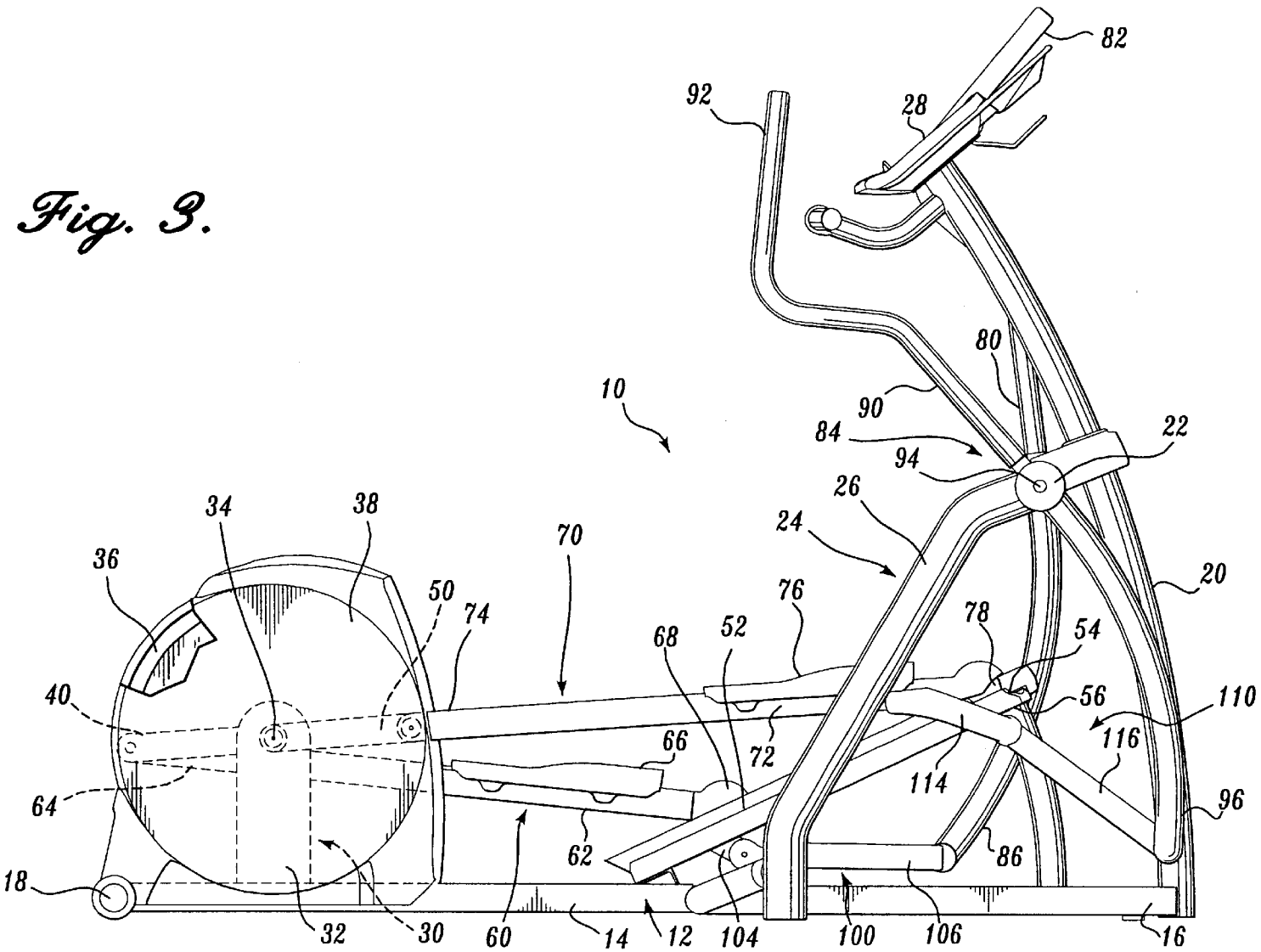
FIG. 3 illustrates a side view of the exercise device of FIG. 1.

FIGS. 1–3 illustrate a preferred embodiment of a exercise device 10 constructed in accordance with the present invention that exercises both the upper and lower body in associated motion, while preventing derailment or other related instability of the lower body linkage, due to the connection and force imparted from the upper body linkage. Briefly described, the exerciser 10 includes a frame 12 which has a forward upright member 20 that extends upwardly and curves slightly rearwardly from a substantially horizontal, longitudinal central member 14 of the frame 12. Towards the rear region of the frame 12 are upwardly extending left and right axle mounts 30 and 32. The axle mounts 30 and 32 support a transverse axle 34 which is preferably operatively connected to a flywheel 36. The left and right ends of the transverse axle 34 rotatably engage left and right crank arm assemblies 40 and 50. Left and right foot links 60 and 70 each include a forward end 62 and 72, a rearward end 64 and 74, and a foot support portion 66 and 76 therebetween. The rearward ends 64 and 74 of the foot links 60 and 70 engage the crank arm assemblies 40 and 50 such that the foot support portion 66 and 76 of the foot links travel in an arcuate reciprocal path as the transverse axle 34 rotates.

The forward ends 62 and 72 of the foot links 60 and 70 preferably are supported by rollers 68 and 78, which engage guide tracks 42 and 52 that are mounted to the frame 12. The forward ends 62 and 72 of the foot links 60 and 70 are operatively connected to safety engagement assemblies 100 and 110, which in turn are operatively connected to the coupling regions 86 and 96 of left and right swing arm mechanisms 80 and 90, respectively. The swing arm mechanisms 80 and 90 are rotatably connected to the forward upright member 20 of the frame 12 at their respective pivot points 84 and 94. The swing arm mechanisms 80 and 90 further contain left and right hand-gripping portions 82 and 92. Each safety engagement assembly 100 and 110 includes an abutment arm 106 and 116, and a curved attachment link 104 and 114, which together prevent the derailment of the foot link rollers 68 and 78 from the guide tracks 42 and 52.

The embodiment of the present invention as shown in FIGS. 1–3 will now be described in greater detail. The frame 12 includes a longitudinal central member 14 that terminates at forward and rearward end portions 16 and 18. Preferably, the forward end portion 16 of the frame 12 simply terminates as the end of the longitudinal central member 14, while the rearward end portion 18 terminates as a relatively shorter transverse member. Ideally, but not essentially, the frame 12 is composed of tubular members that are relatively light in weight but that provide substantial strength and rigidity. The frame 12 may also be composed of solid members that provide the requisite strength and rigidity while maintaining a relatively light weight.

The forward upright member 20 extends upwardly and slightly rearwardly from the forward end 16 of the floor engaging frame 12. Preferably, the upright member 20 is slightly rearwardly curved. However, the forward member 20 may be configured at other upward angulations without departing from the scope of the present invention. A relatively short, transversely oriented crossbar member 22 is connected to the forward upright member 20, approximately halfway up the member 20. Left and right balance arms 24 and 26 depend downwardly from each end of the crossbar member 22 to engage the floor on each side of the longitudinal central member 14 near the forward end of the exercise device 10, thereby increasing stability. Ideally, but not essentially, these members are composed of a material similar to that described above, and are formed in quasi-circular tubular configurations.

Preferably, a view screen 28 is securably connected to the upper end of the forward upright member 20, at an orientation that is easily viewable to a user of the device 10. Instructions for operating the device as well as courses being traveled may be located on the view screen 24 in an exemplary embodiment. In some embodiments of the present invention, electronic devices may be incorporated into the exerciser device 10 such as timers, odometers, speedometers, heart rate indicators, energy expenditure recorders, etc. This information may be routed to the view screen 28 for ease of viewing for a user of the device 10.

In the exemplary preferred embodiment shown in FIG. 3, the axle mounts 30 and 32 are located toward the rearward end 18 of the frame 12. The axle mounts 30 and 32 are attached to the frame 12 and extend approximately upward from the substantially horizontal, longitudinal central member 14. The transverse axle 34 is rotatably housed in the upper region of the axle mounts 30 and 32. These regions of the axle mounts 30 and 32 which house the ends of the transverse axle 34 contain low friction engaging systems (not shown), such as bearing systems, to allow the transverse axle 34 to rotate with little resistance within the housing in the axle mounts 30 and 32.

Referring again to the exemplary preferred embodiment shown in FIG. 3, the transverse axle 34 connects to a flywheel 36 contained within a center housing 38. Such flywheels are known in the art. However, in other preferred embodiments, the transverse axle 34 may not incorporate a flywheel 36 and/or central housing 38, without departing from the scope of the present invention (provided that the foot links 60 and 70 are coupled to one another in some fashion, albeit directly or indirectly). The transverse axle 34 may also be operatively connected to a capstan-type drive (not shown) in some embodiments, to allow the axle 34 to rotate in only one direction.

The elliptical motion exerciser 10 further contains longitudinally extending left and right foot links 60 and 70. As shown in FIGS. 1–3, the foot links are illustrated in the shape of elongated, relatively thin beams. The foot links 60 and 70 are aligned in approximately parallel relationship with the longitudinal central member 14 of the frame 12. The foot support portions 66 and 76 are positioned near the forward end of the foot links 60 and 70, and provide stable foot placement locations for the user of the device. In some exemplary embodiments the foot support portions 66 and 76 are configured to form toe straps and/or toe and heel cups (not shown) which aid in forward motion recovery at the end of a rearward or forward striding motion of a user's foot.

Left and right crank arm assemblies 40 and 50 couple the rearward ends 64 and 74 of the foot links 60 and 70 to the ends of the transverse axle 34. In a preferred embodiment of the present invention shown in FIGS. 1–3, the crank arm assemblies 40 and 50 are comprised of single left and right crank arm members. In this exemplary embodiment the proximal ends of the crank arm members 40 and 50 engage the ends of the transverse axle 34, while the distal ends of the crank arm members 40 and 50 are rotatably connected to the rearward ends 64 and 74 of the foot links 60 and 70. In this configuration, the rearward ends 64 and 74 of the foot links 60 and 70 orbit about the transverse axle 34 as the axle rotates, and the foot support portions 66 and 76 of the foot links 60 and 70 travel in a reciprocal, elliptical path of motion. However, the elliptical path of the foot support portions 66 and 76, and indeed the motion of the entire foot links 60 and 70 can be altered into any number of configurations by changing the composition or dimensions of the crank arm assemblies 40 and 50. For example, the length of the single left and right crank arms shown in FIG. 1 can be lengthened or shortened to modify the path of the foot links 60 and 70. Further, the left and right crank arm assemblies 40 and 50 can be composed of multiple crank arm member linkages to alter the path of travel of the foot links 60 and 70 in a wide variety of aspects.

In an alternate embodiment of the present invention the rearward ends 64 and 74 of the foot links 60 and 70 are rotationally connected directly to a flywheel which functions to couple the foot links 60 and 70 to a pivot axis (equivalent to the axis of the transverse axle 34) and permit rotation thereabout. In this embodiment, the flywheel is preferably a double flywheel that supports rotation about a central axis. It will also be appreciated that various mechanical arrangements may be employed to embody the crank arm assemblies 40 and 50 in operatively connecting the foot links 60 and 70 to each other. Such variations may include a larger flywheel, a smaller flywheel, or may eliminate the flywheel entirely and incorporate a cam system with connecting linkage, provided that the foot links are coupled so as to permit an arcuate path of travel by the foot support portions 66 and 76 of the foot links 60 and 70.

Figure 4:
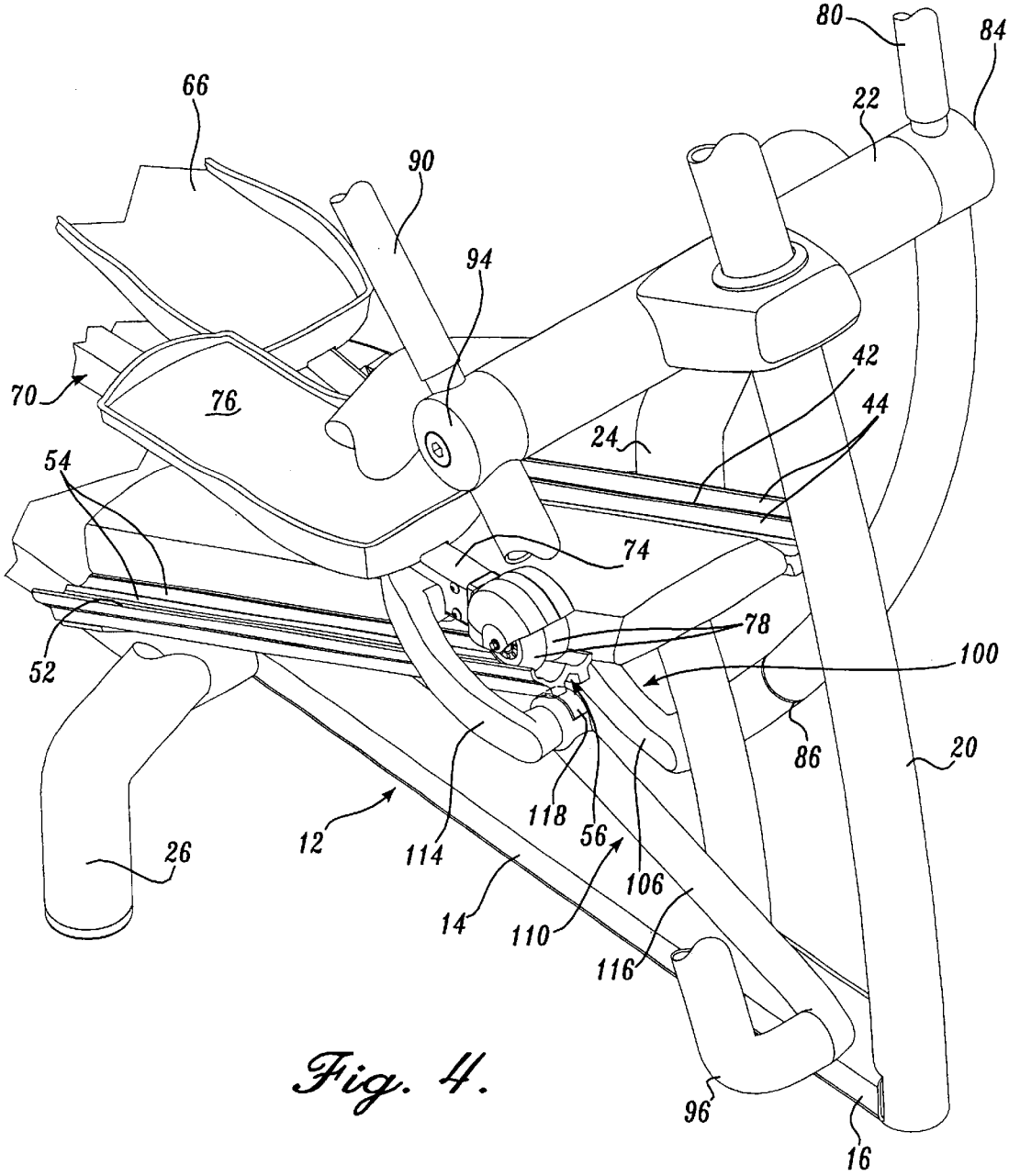
FIG. 4 illustrates a close-up perspective view of a portion of the exercise device of FIG. 1, that includes the abutment arm and curved attachment link of the safety engagement assembly which prevents the derailment of the foot link rollers from the guide track.
Figure 5:
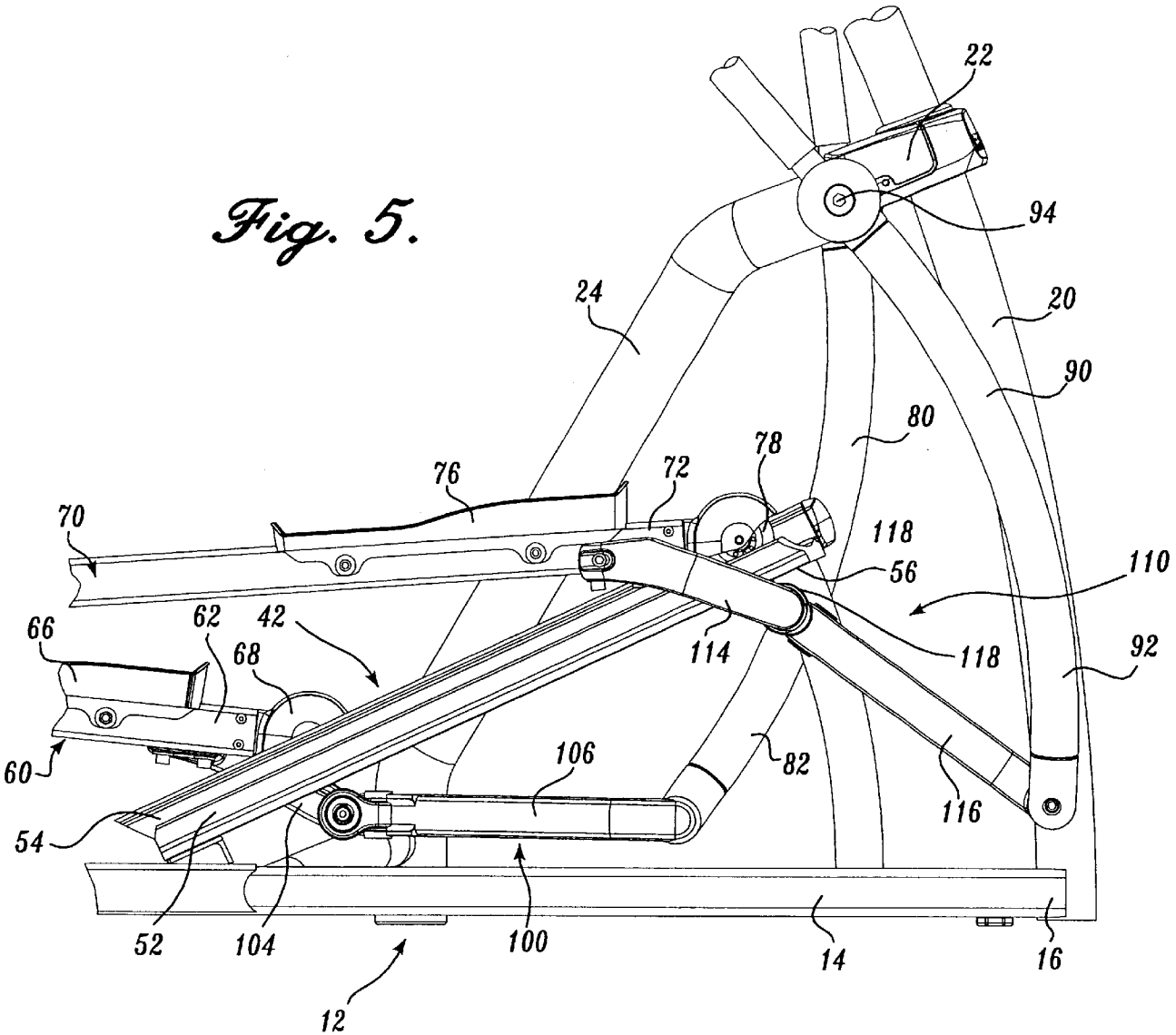
FIG. 5 illustrates a close-up side view of the exercise device of FIG. 1, that includes the abutment arm and curved attachment link of the safety engagement assembly which prevents the derailment of the foot link rollers from the guide track.

As most clearly shown in FIGS. 4–5, the exerciser device 10 further contains left and right guide tracks 42 and 52. The guide tracks 42 and 52 can be completely separate members, or can be part of one single connected unit (as shown in FIGS. 4 and 5). The guide tracks 42 and 52 attach to the longitudinal central member 14 of the frame 12 at an angled inclination. In one preferred embodiment, the angle of inclination is approximately 30 degrees. Preferably, the upper surface of the guide tracks 42 and 52 are shaped to contain two longitudinally extending, adjacent engagement grooves 44 and 54. These engagement grooves 44 and 54 give the upper surface of the guide tracks 42 and 52 a "W-shaped" cross-sectional configuration. The engagement grooves 44 and 54 are specifically sized and shaped to correspondingly mate with the rollers 68 and 78 of the foot links 60 and 70 in order to assist in the lateral containment of the rollers 68 and 78 on the guide tracks. In addition, the lower surface of the guide tracks 42 and 52 preferably contain longitudinally extending stabilizing troughs 46 and 56 (See FIG. 4).

The left and right forward ends 62 and 72 of the foot links 60 and 70 terminate in left and right engagement rollers 68 and 78 which ride along the above described grooves 44 and 54 of the guide tracks 42 and 52. Preferably, the engagement rollers 68 and 78 are actually pairs of rollers. The engagement rollers 68 and 78 rotate about axles that are affixed to the forward ends 62 and 72 of the foot links 60 and 70. During use of the exercise device 10, the engagement rollers 68 and 78 at the front of the foot links 60 and 70 translate back and forth the length of the guide tracks 42 and 52 in rolling engagement within the grooves 44 and 54, as the foot support portions 66 and 76 of the foot links 60 and 70 travel in an arcuate path of motion, and the rearward ends 64 and 74 of the foot links 60 and 70 rotate about the transverse axle 34. In an alternate preferred embodiment of the present invention, the engagement rollers 68 and 78 could be replaced with sliding engagement mechanisms without departing from the scope of the present invention.

Figure 6:
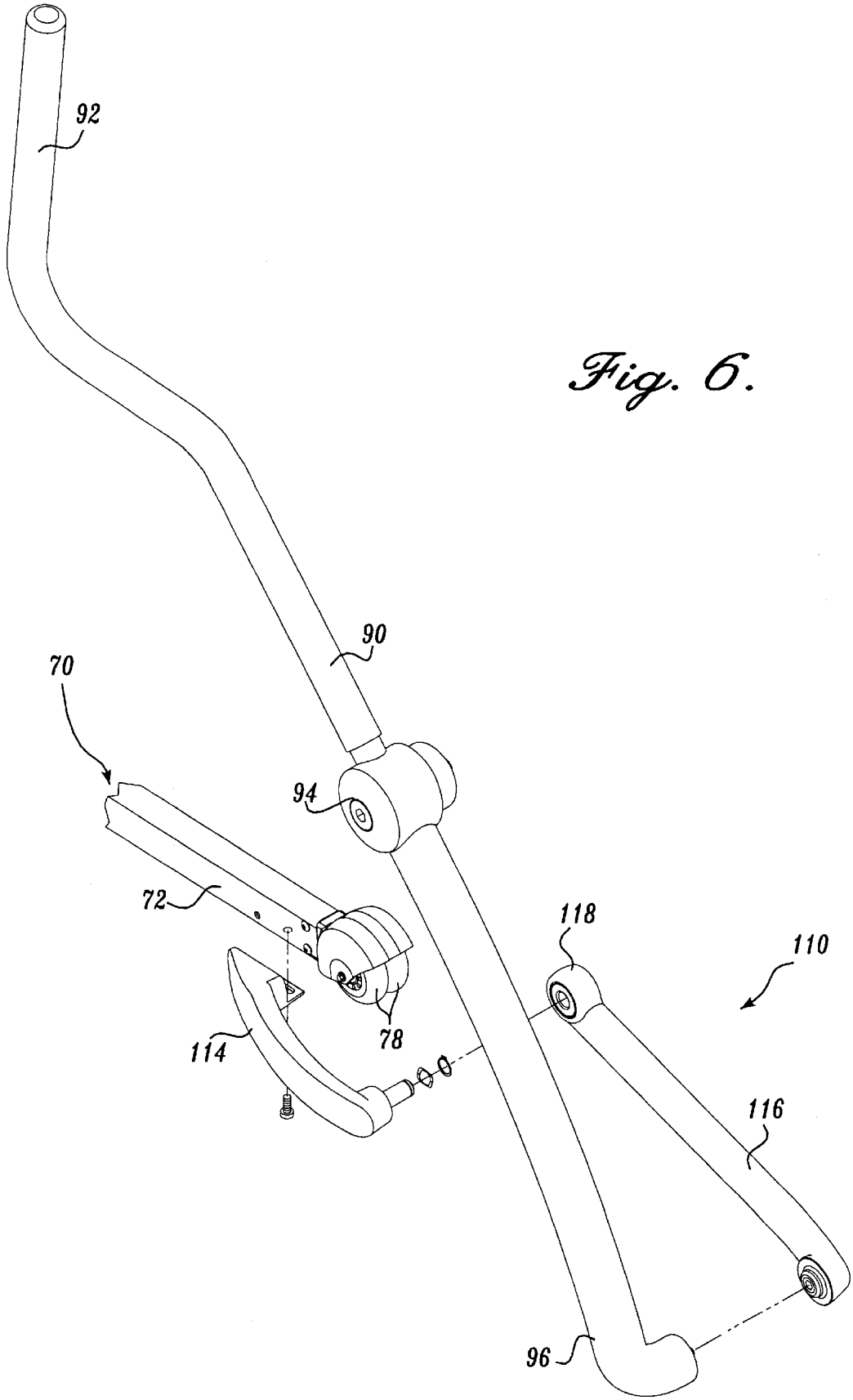
FIG. 6 illustrates an exploded view of the exercise device of FIG. 1, that includes a swing arm mechanism, safety engagement assembly, and foot link with attached rollers.

As shown in FIGS. 4–6, left and right safety engagement assemblies 100 and 110 operatively connect the forward ends 62 and 72 of the foot links 60 and 70 to the coupling regions 86 and 96 of swing arm mechanisms 80 and 90. Preferably, each of the safety engagement assemblies 100 and 110 includes a curved attachment link 104 and 114, and an abutment arm 106 and 116. In alternate preferred embodiments, either more or fewer members can be utilized to produce the safety engagement assemblies 100 and 110 without departing from the scope of the present invention. In an exemplary embodiment, the abutment arms 106 and 116 each have an abutment knob 108 and 118. The abutment knobs 108 and 118 are designed to withstand intermittent contact with the stabilizing troughs 46 and 56 on the lower surface of the guide tracks 42 and 52 during use of the exercise device 10.

In alternate embodiments of the present invention, the safety engagement assemblies 100 and 110 could be configured such that the abutment knobs 108 and 118 were located on the curved attachment links 104 and 114 (or the abutment knobs could be deleted altogether), without departing from the scope of the present invention. Further, depending on the exact configuration and number of links utilized in the safety engagement assemblies 100 and 110, the curved attachment links 104 and 114 may not even be curved, but rather may be linear attachment links. As clearly illustrated in FIG. 6, each curved attachment link 104 and 114 is rotatably coupled to an abutment arm 106 and 116. Each curved attachment link 104 and 114 is fixedly secured to the forward end 62 and 72 of a foot link 60 and 70, and each abutment arm 106 and 116 is rotatably coupled to the coupling region 86 and 96 of a swing arm mechanism 80 and 90.

Referring again to FIGS. 1–3, the exerciser device 10 contains left and right swing arm mechanisms 80 and 90. Respectively, each swing arm mechanism 80 and 90 contains a hand-gripping portion 82 and 92, a pivot point 84 and 94, and a coupling region 86 and 96. As described above, the coupling regions 86 and 96 of the swing arm mechanisms 80 and 90 rotatably connect to the safety engagement assemblies 100 and 110, and turn to the foot support portions 66 and 76 of the foot links 60 and 70. The pivot points 84 and 94 rotatably secure the swing arm mechanisms 80 and 90 to each end of the crossbar member 22 of the frame 12.

The hand-gripping portions 82 and 92 of the swing arm mechanisms 80 and 90 are grasped by the hands of the individual user, and allow upper body arm and shoulder exercising motions to be incorporated in conjunction with the reciprocal, elliptical exercising motion traced out by the user's feet. As can be more readily understood with reference to FIGS. 1–3, the linking of the swing arm mechanisms 80 and 90 to the foot links 60 and 70, via the safety engagement assemblies 100 and 110, and the rotational securement of the swing arm mechanisms 80 and 90 to the forward upright member 20 of the frame 12 at the pivot points 84 and 94, results in generally rearward, arcuate motion of a hand-gripping portion being correspondingly linked to a generally forward, arcuate motion of a respective foot support portion, and vice versa.

In an exercise device such as the present invention, where upper body linkages (the swing arm mechanisms 80 and 90) are operatively associated with lower body linkages (the foot links 60 and 70) there is a tendency for force imparted by the user into an upper body linkage to be translated into a "lifting" vector (as well as a forward vector) in the lower body linkage. For many exercise devices that have the upper body linkages run along some type of guide rail or ramp, this can be very problematic, since the aforedescribed "lifting" force can cause a lower body linkage to disengage or derail from its respective guide rail. This problem is particularly exacerbated when the upper body linkage and lower body linkage are directly coupled.

An exercise device 10 that is constructed in accordance with the present invention, addresses these concerns and results in a device that effectively maintains the foot links 60 and 70 (and specifically the rollers 68 and 78) in continuous engagement with the guide tracks 42 and 52. This is partially due to the swing arm mechanisms 80 and 90 being configured to extend downwardly beneath the horizontal level of the forward ends 62 and 72 of the foot links 60 and 70. In this configuration the safety engagement assemblies 100 and 110 interconnect the swing arm mechanisms 80 and 90 to the foot links 60 and 70, and translate any upward momentum into forward momentum. Additionally, the abutment knobs 108 and 118 of the abutment arms 106 and 116 in the safety engagement assemblies 100 and 110 track in aligned transition beneath the stabilizing troughs 46 and 56 in the guide rail lower surfaces, and substantially prevent the foot links from disengaging from the guide rails through intermittent contact (if necessary) with the lower surfaces of the guide tracks 42 and 52. In this manner, the present invention incorporates safety engagement assemblies between the device's upper body linkage and lower body linkage to simulate natural walking and running motions, and exercise a large number of muscles, while maintaining a high level of beneficial safety and stability, and preventing the undesirable derailment and disengagement concerns associated with some prior art exercise equipment.

To use the present invention, the user stands on the foot support portions 66 and 76 and grasps the hand-gripping portions 82 and 92. The user imparts a rearward stepping motion on one of the foot support portions and a forward stepping motion on the other foot support portion, thereby causing the transverse axle 34 to rotate in a clockwise direction (when viewed from the right side as shown in FIG. 1), due to the crank arm assemblies 40 and 50 coupling the motion of the foot links 60 and 70 to the rotation of the transverse axle 34. In conjunction with the lower body action, the user also imparts a substantially forward pushing motion on one of the hand-gripping portions and a substantially rearward pulling motion on the other hand-gripping portion. Due to the rotatable connection of the coupling regions 86 and 96 of the swing arm mechanisms 80 and 90 to the forward ends 62 and 72 of the foot links 60 and 70 (via the safety engagement assemblies), and the rotational securement of the swing arm mechanisms 80 and 90 to the forward upright member 20 of the frame 12 at their pivot points 84 and 94, each hand-gripping portion moves forward as its respective foot support portion moves rearward, and vice versa.

The foot links 60 and 70 are attached to the transverse axle 34 by the crank arm assemblies 40 and 50 such that one foot support portion moves substantially forward as the other foot support portion moves substantially rearward. In this same fashion one hand-gripping portion moves forward as the other hand-gripping portion moves rearward (e.g., when the left hand-gripping portion 82 moves forward, the left foot support portion 66 moves rearward, while the right foot support portion 76 moves forward and the right hand-gripping portion 92 moves rearward). Therefore, the user can begin movement of the entire foot link and swing arm mechanism linkage by moving any foot support portion or hand-gripping portion, or preferably by moving all of them together.

A preferred embodiment of the present invention may further include a friction break or other resistance adjustable mechanism (not shown). Preferably, the resistance adjustment mechanism would be associated with the flywheel 36 or the transverse axle 34 for the purpose of imposing drag on the wheel or the axle so as to increase the amount of exercise provided by the exercise device 10. The resistance adjustment mechanism may be adjusted by an adjustment knob (not shown) operating through a flexible cable (not shown) upon some type of frictional pad assembly (not shown). These types of resistance adjustment mechanisms and their associated assemblies are well known to those skilled in the art. Other types of braking devices such as a magnetic brake and the like may also be similarly employed.

Figure 7:
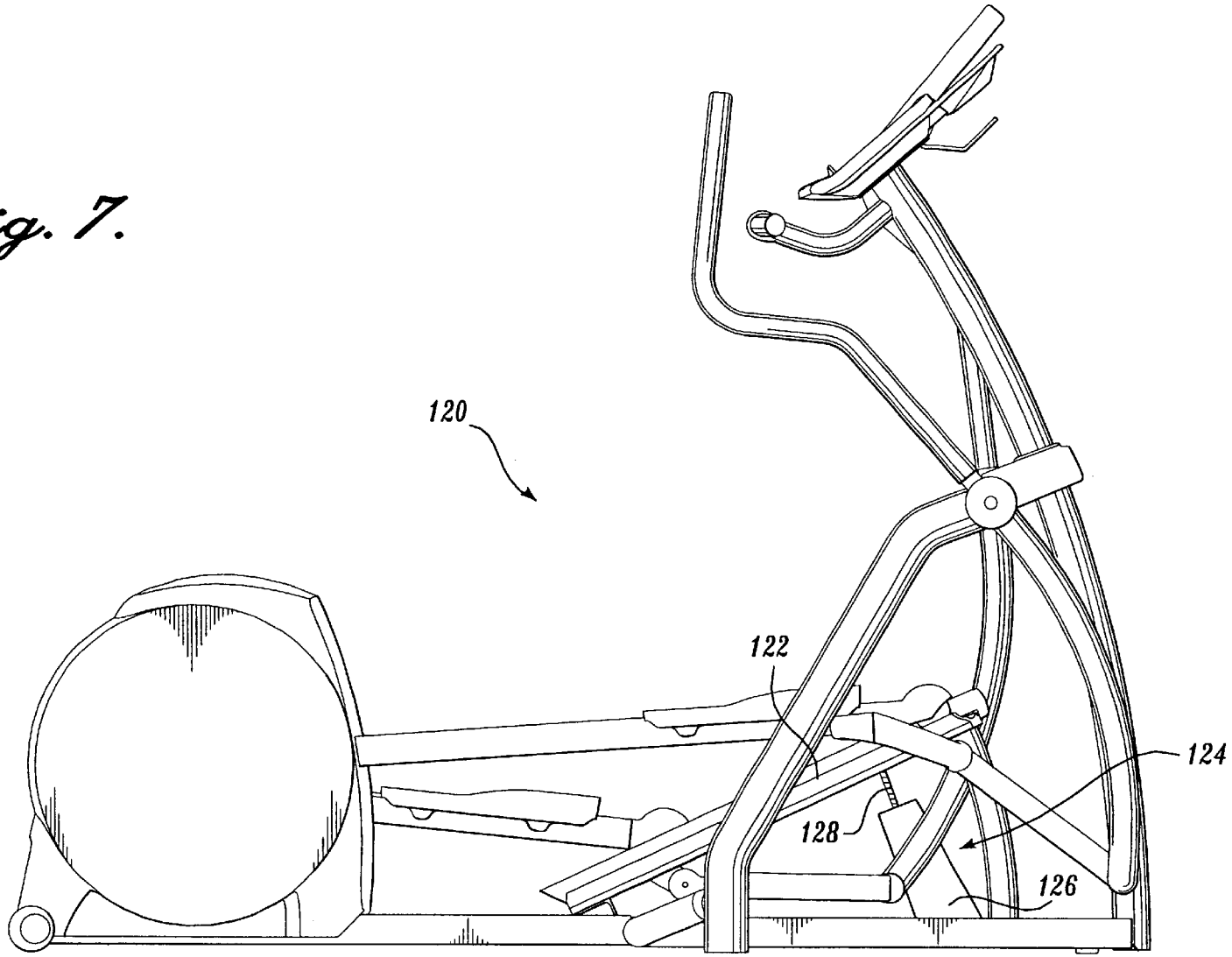
FIG. 7 illustrates a side view of the exercise device of the present invention that incorporated a selectively adjustable guide track.

FIG. 7 illustrates another preferred embodiment exercise device 120 of the present invention containing guide tracks 122 having selectively adjustable inclination. The exercise device 120 shown in FIG. 7 is constructed and functions similarly to the exercise device 10, shown in FIGS. 1–6. Accordingly, the exercise device 120 will be described only with respect to those components that differ from the components of the exercise device 10.

In this alternate preferred embodiment, the guide tracks 122 are not statically mounted to the frame 12, but rather incorporate a mechanism 124 for selectively adjusting the inclination of the guide tracks. In one preferred embodiment, the mechanism 124 is comprised simply of a motor 126 and a lead screw 128 for adjusting the height of one end of the guide tracks 122. This selective inclination adjustment mechanism 124 may be either motorized or manually actuated. Many different types of height adjustment mechanisms are know in the art and are adequate for this purpose. In the embodiment illustrated in FIG. 7, the guide tracks 122 pivot about a fixed axis. In yet another embodiment, the position of the guide tracks translate in their entirety, instead of actuating purely through rotational motion.

In another aspect of the present invention, any of the above-described preferred embodiments may further contain flexibly coordinated mechanisms in the linkage between the left and right foot support portions 66 and 76 of the left and right foot links 60 and 70 that substantially relate the movement of the foot links to each other while permitting some degree of uncoordinated motion between the foot links. Specifically, flexibly coordinating mechanisms (not shown), may be incorporated between each foot link 60 and 70 and their respective crank arm assembly 40 and 50. In another preferred embodiment, the flexibly coordinating mechanisms (e.g., such as elastomeric torsion springs) may be incorporated between each coupling mechanism 40 and 50 and the transverse axle 34. In still another preferred embodiment, the flexibly coordinating mechanism may be configured as a flexibly coordinated, bifurcated transverse axle (not shown), that substantially relates the movement of the foot links to each other, while permitting some degree of uncoordinated motion between the foot links, and which replaces the transverse axle 34.

Preferably, a flexibly coordinating member is also incorporated between each hand-gripping portion 82 and 92 and each respective foot support portion 66 and 76 to induce flexibly coordinated motion between the hand-gripping portions and the foot support portions, such that when one of the hand-gripping portions moves rearward the flexibly coordinating member forces its respective foot support portion to move forward a substantially related percentage amount, and vice versa. This flexibly coordinated motion does, however, allow a certain amount (depending upon the flexibility of the flexibly coordinating member) of uncoordinated motion between each respective hand-gripping portion and foot link. In this embodiment of the present invention, preferably, one or more of the members of the safety engagement assemblies 100 and 110 are composed of a flexible and resilient material, and thus, act as the flexibly coordinating members. However, additional members may also be added to safety engagement assemblies 100 and 110 specifically to fulfill this purpose. The relative movement between the hand-gripping portions and the foot support portions can be varied by modifying the location of the pivot points 84 and 94 along the length of the swing arm mechanisms 80 and 90. However, the flexible coordination provided by the flexibly coordinated members does allow some degree of variation in the relative motion between the hand-gripping portions 82 and 92 and the foot support portions 66 and 76.

The present invention has been described in relation to a preferred embodiment and several alternate preferred embodiments. One of ordinary skill after reading the foregoing specification, may be able to effect various other changes, alterations, and substitutions or equivalents thereof without departing from the concepts disclosed. It is therefore intended that the scope of the letters patent granted hereon will be limited only by the definitions contained in the appended claims and equivalents thereof.

The embodiments of the invention in which an exclusive property or privilege is claimed are defined as follows:

1. An exercise device, comprising:

a frame defining a longitudinal axis, the frame having a rearward end and a forward end;

a left exercise assembly, including i) a left guide track having an elevated forward end, ii) a left foot link having a rearward end that is constrained to move in an orbital path approximately parallel to the longitudinal axis and a forward end that reciprocally engages the left guide track, iii) an elongate left swing arm having a pivotal connection to the frame, the left swing arm having an upper portion extending above the pivotal connection and a lower end disposed below the pivotal connection at a vertical position lower than the elevated forward end of the left guide track, and iv) a left engagement mechanism having a first end coupled to the lower end of the left swing arm and a second end coupled to the forward end of the left foot link, such that a rearward force applied to the upper portion of the left swing arm will produce a force on the forward end of the left foot link having a downward component; and a right exercise assembly, including i) a right guide track having an elevated forward end, ii) a right foot link having a rearward end that is constrained to move in an orbital path approximately parallel to the longitudinal axis and a forward end that reciprocally engages the right guide track, iii) an elongate right swing arm having a pivotal connection to the frame, the right swing arm having an upper portion extending above the pivotal connection and a lower end disposed below the pivotal connection at a vertical position lower than the elevated forward end of the right guide track, and iv) a right engagement mechanism having a first end coupled to the lower end of the right swing arm and a second end coupled to the forward end of the right foot link, such that a rearward force applied to the upper portion of the right swing arm will produce a force on the forward end of the right foot link having a downward component.

2. The exercise device of claim 1, wherein the left and right foot links each include at least one roller, and the left and right guide tracks each have an upper surface that is adapted to rollably receive of the respective left and right foot link roller.

3. The exercise device of claim 2, wherein the rollers each comprise a pair of wheels and the left and right guide rail upper surfaces are W-shaped.

4. The exercise device of claim 1, wherein the left and right guide tracks are mounted at an angled of inclination from horizontal.

5. The exercise device of claim 1, wherein the left and right engagement mechanisms each include an abutment arm and a curved attachment link, wherein the abutment arm is rotatably coupled at one end to the associated swing arm and at the opposite end to the associated curved attachment link, and the curved attachment link is fixedly secured to the associated foot link.

6. The exercise device of claim 1, wherein the frame comprises a longitudinal member, an upright member extending upwardly from the longitudinal member and a transverse member extending outwardly transversely from the upright member and wherein the left and right swing arms are pivotally connected to opposite ends of the transverse member.

7. The exercise device of claim 6, wherein the frame further comprises a plurality of balance arms depending downwardly from the transverse member to provide support for the exercise device.

8. The exercise device of claim 6 further comprising an electronic view screen attached to the upright member for displaying exercise information.

9. The exercise device of claim 1, further comprising a rearwardly disposed flywheel, wherein the left and right foot links are rotationally coupled to the flywheel with left and right crank arm assemblies respectively.

10. An exercise device for exercising multiple muscle groups simultaneously, the exercise device comprising:

a rotatable member;

a frame having a rearward portion adapted to rotatably support the rotatable member;

a left and a right guide member attached to the frame, each guide member having an elevated forward end;

a left and a right foot link, each foot link having a rearward end coupled to the rotatable member such that the rearward end of each foot link will orbit one revolution for each revolution of the rotatable member, and a forward end adapted to reciprocally engage the respective guide member;

a left and a right swing arm, each swing arm pivotally coupled to the frame, each swing arm having an upper portion and a lower end and wherein the lower end is disposed lower than the elevated forward ends of the left and right guide members;

a left and a right engagement mechanisms, each engagement mechanism having a forward end coupled to the lower end of the respective swing arm and a rearward end coupled to the forward end of the respective foot link;

such that a rearward force applied to the upper portion of either swing arm will produce a force in the forward end of the associated foot link that biases the foot link towards the associated guide member.

11. The exercise device of claim 10, wherein the left and right foot links each include rollers, and the left and right guide members each have a grooved upper surface that is adapted to rollably receive one of the left and right rollers.

12. The exercise device of claim 11, wherein the rollers each comprise a pair of wheels and the left and right guide members' upper surfaces are W-shaped.

13. The exercise device of claim 10, wherein the guide members are mounted at an angled of inclination from horizontal.

14. The exercise device of claim 10, wherein the left and right engagement mechanisms each include an abutment arm and a curved attachment link, wherein the abutment arm is rotatably coupled at one end to the associated swing arm and at the opposite end to the associated curved attachment link, and the curved attachment link is fixedly secured to the associated foot link.

15. The exercise device of claim 10, wherein the frame comprises a longitudinal member, an upright member extending upwardly from the longitudinal member and a transverse member extending outwardly from the upright member and wherein the left and right swing arms are pivotally connected to opposite ends of the transverse member.

16. The exercise device of claim 15, wherein the frame further comprises a plurality of balance arms depending downwardly from the transverse member to provide support for the exercise device.

17. The exercise device of claim 15 further comprising an electronic view screen attached to the upright member for displaying exercise information.

18. The exercise device of claim 10, wherein the rotational member comprises a flywheel and the left and right foot links are rotationally coupled to the flywheel with left and right crank arm assemblies respectively.

19. An exercise device, comprising:

a frame having a longitudinal axis defined relative to the frame;

a rotatable member;

left and right foot links, each foot link having a forward portion and a rearward portion;

left and right coupling assemblies attached to the rearward portion of the left and right foot links respectively, wherein the left and right coupling assemblies orbitally couple the respective foot member to the rotatable member;

left and right guides attached to the frame and disposed at least in part beneath the forward portion the left and right foot links, respectively;

left and right swing arms, each swing arm having an upper portion and a lower end, wherein the left and right swing arms are pivotally coupled to the frame at a location between the upper portion and the lower end;

left and right safety engagement assemblies having first and second ends and pivotally coupled at the first end to the left and right swing arms, respectively, and at the second end to the forward portion of the left and right foot links, respectively, such that a rearward force applied to the upper portion of either swing arm will bias the associated foot link toward the associated guide.

20. An exercise device, comprising:

a frame defining a longitudinal axis, the frame having a rearward end and a forward end;

a left exercise assembly, including i) a left guide track having an elevated forward end, ii) a left foot link having a rearward end that is constrained to move in an orbital path approximately parallel to the longitudinal axis and a forward end that reciprocally engages the left guide track, iii) an elongate left swing arm having a pivotal connection to the frame, the left swing arm having an upper portion extending above the pivotal connection and a lower end disposed below the pivotal connection at a vertical position lower than the elevated forward end of the left guide track, and iv) a left engagement mechanism having a first end coupled to the lower end of the left swing arm and a second end coupled to the forward end of the left foot link; wherein the left engagement mechanism slidably encaptures a portion of the left guide track whereby the left foot link is prevented from disengaging the left guide track; and a right exercise assembly, including i) a right guide track having an elevated forward end, ii) a right foot link having a rearward end that is constrained to move in an orbital path approximately parallel to the longitudinal axis and a forward end that reciprocally engages the right guide track, iii) an elongate right swing arm having a pivotal connection to the frame, the right swing arm having an upper portion extending above the pivotal connection and a lower end disposed below the pivotal connection at a vertical position lower than the elevated forward end of the right guide track, and iv) a right engagement mechanism having a first end coupled to the lower end of the right swing arm and a second end coupled to the forward end of the right foot link; wherein the right engagement mechanism slidably encaptures a portion of the right guide track whereby the right foot link is prevented from disengaging the right guide track.

21. The exercise device of claim 20, wherein the left and right foot links each include at least one roller, and the left and right guide tracks each have an upper surface that is adapted to rollably receive of the respective left and right foot link roller.

22. The exercise device of claim 21, wherein the rollers each comprise a pair of wheels and the left and right guide rail upper surfaces are W-shaped.

23. The exercise device of claim 20, wherein the left and right guide tracks are mounted at an angled of inclination from horizontal.

24. The exercise device of claim 20, wherein the left and right engagement mechanisms each include an abutment arm and a curved attachment link, wherein the abutment arm is rotatably coupled at one end to the associated swing arm and at the opposite end to the associated curved attachment link, and the curved attachment link is fixedly secured to the associated foot link.

25. The exercise device of claim 20, wherein the frame comprises a longitudinal member, an upright member extending upwardly from the longitudinal member and a transverse member extending outwardly transversely from the upright member and wherein the left and right swing arms are pivotally connected to opposite ends of the transverse member.

26. The exercise device of claim 25, wherein the frame further comprises a plurality of balance arms depending downwardly from the transverse member to provide support for the exercise device.

27. The exercise device of claim 25 further comprising an electronic view screen attached to the upright member for displaying exercise information.

28. The exercise device of claim 20, further comprising a rearwardly disposed flywheel, wherein the left and right foot links are rotationally coupled to the flywheel with left and right crank arm assemblies respectively.

* * * * *

UNITED STATES PATENT AND TRADEMARK OFFICE

CERTIFICATE OF CORRECTION

PATENT NO. : 6,752,744 B2
DATED : June 22, 2004
INVENTOR(S) : P. Arnold et al.

It is certified that error appears in the above-identified patent and that said Letters Patent is hereby corrected as shown below:

Column 11,
Line 44, “receive of the respective” should read -- receive the respective --
Line 50, “an angled of” should read -- an angle of --

Column 12,
Line 28, “a left and a right engagement mechanisms,” should read -- a left and a right engagement mechanism, --
Line 45, “an angled of” should read -- an angle of --

Column 13,
Line 18, “forward portion the left” should read -- forward portion of the left --

Column 14,
Line 20, “receive of the respective” should read -- receive the respective --
Line 26, “an angled of” should read -- an angle of --

Signed and Sealed this

Ninth Day of November, 2004

JON W. DUDAS
*Director of the United States Patent and Trademark Office*